United States Patent [19]

Harada et al.

[11] 4,003,229

[45] Jan. 18, 1977

[54] METHOD FOR COMPENSATING TAIL END

[75] Inventors: Toshio Harada; Shinichi Nakamata, both of Kisarazu; Shiro Araki; Koei Nakashima, both of Kitakyushu; Hironori Kawasaki, Kimitsu; Kazuo Watanabe, Kitakyushu; Keiichi Miura, Kobe, all of Japan

[73] Assignees: Nippon Steel Corporation; Mitsubishi Electric Corporation, both of Tokyo, Japan

[22] Filed: Mar. 26, 1975

[21] Appl. No.: 562,027

Related U.S. Application Data

[63] Continuation-in-part of Ser. No. 394,845, Sept. 6, 1973, abandoned.

[30] Foreign Application Priority Data

Sept. 6, 1972 Japan ..... 47-88688

[52] U.S. Cl. ..... 72/15; 72/249

[51] Int. Cl.[2] ..... B21B 37/00

[58] Field of Search ..... 72/6–12, 72/14, 15, 205, 17, 234, 19

[56] References Cited

UNITED STATES PATENTS

| | | | |
|---|---|---|---|
| 3,555,862 | 1/1971 | Yoshino et al. | 72/10 |
| 3,645,121 | 2/1972 | Pfeiffer et al. | 72/205 |

*Primary Examiner*—Milton S. Mehr
*Attorney, Agent, or Firm*—Perry Carvellas

[57] ABSTRACT

There is described a method for compensating tail end of rolling materials for rolling shaped steel sections in an optimum manner. According to this method, in a continuous tension free rolling operation of a shaped steel section comprising a flat section and a flange section through a plural number of roll stands, the operating speed of a first roll stand is reduced by a predetermined amount as compared with a second or succeeding roll stand when the crop at the tail end of the rolling material enters the first rolling unit, thereby to prevent overfeeding.

4 Claims, 6 Drawing Figures

METHOD FOR COMPENSATING TAIL END

This invention is a Continuation-In-Part application of Ser. No. 394,845, now abandoned, filed by the Applicants of the present invention on Sept. 6, 1973 and assigned to the same assignee.

BACKGROUND OF THE INVENTION

The present invention is directed to a method for compensating tail ends of rolling materials in continuous rolling operation of shaped steel sections.

In the use of steel mills for rolling steel material it is frequently necessary to exercise careful control of the operation to avoid errors in the material being rolled. For example, when rolling tubular material, the material is stretched as it is rolled and the thickness of the wall is reduced as the tubular material passes through the various roll stands. The reduction in thickness is accomplished by applying a tension to the tubular material as it passes through the roll stands. This tension is generally applied by having the speed of successive roll stands operate at a speed greater than that of the preceding roll stands. However, the tension thereby produced does not only occur between two successive roll stands but, as the tubular material passes a particular roll stand all of the previous roll stands exert a retarding force to increase the tension on the tubular material. Because of the tension operating condition, the tail end of the tubular material is generally thicker than a central part of the tubular material, because the tail end of the tubular material does not have the retarding force by the preceding roll stands.

A solution to this problem for tubular materials in suggested in U.S. Pat. No. 3,645,121 which provides an increased amount of tension on the end portion of the tubular material in a stepwise variation of the rolling speeds of the roll stand, to thereby introduce a stepwise graded tension increase onto the end portion of the tubular material. This patent increases the tension by sequentially modifying the speeds of successive roll stands in accordance with a predetermined pattern whereby only the tension in the end portion will be increased without affecting the central portion of the tubular material.

While such techniques are known with regard to rolling of tubular material, a completely different problem exists when rolling shaped steel sections such as H shaped steel sections. In such type of rolling operation, the tension between roll stands is zero during normal rolling. Therefore, the rolling operation itself does not introduce any irregularities in the rolling material. However, the shaped steel sections normally has flanges at its edges. At the end portion of rolling material for such flanged shaped steel sections there is a crop which is cropped and has a deformity and irregularity wherein the flanges are generally lacking at the tail end. In rolling such shaped steel sections, a roll stand is usually provided two sets of rollers in the continuous rolling, namely a vertical set and a horizontal set. As the crop at the tail end enters a particular roll stand, while the horizontal rollers are held in contact with the flat or horizontal section of the rolling material, the vertical rollers which normally engage the flanged edges, are now freed from any rolling load. The result is that there is a reduced amount of contact between the rollers of this particular roll stand rolling the crop compared with the succeeding roll stand which encounters both a vertical and horizontal section. The result is that the tail end of the rolling material between the particular roll stand and the succeeding roll stand is overfed into the succeeding roll stand and there occurs defects in the shape of the rolled material. The compressive force between these two roll stands tends to form a bump or irregularity in the rolled material.

OBJECTS OF THE INVENTION

It is therefore the primary object of the instant invention to provide a method for compensating the tail ends in the continuous rolling operation of shaped steel sections, thereby to avoid the difficulties as mentioned hereinabove.

According to the tail end compensating method of the instant invention, a shaped steel section is continuously rolled in a tension free condition with use of at least two roll stands. When the crop at the tail end of the rolling material enters the first or preceding roll stand, the operating speed of the first roll stand is adjusted in a compensating manner with respect to the second roll stand. As a rule, the first roll stand is operated at a reduced speed thereby to correct the speed ratio between the first and second roll stands. However, instead of reducing the speed of the first roll stand, it is also possible to increase the speed of the second roll stand to attain the similar effects. It will be understood that, by adjusting the speed of either the first roll stand or the second roll stand, the overfeeding of the tail end and the resultant deformations may be avoided in a suitable manner.

The above and other objects, features and advantages of the invention will be apparent from the following description, taken in connection with the accompanying drawings wherein.

PARTICULAR DESCRIPTION OF THE INVENTION

Figure 1:
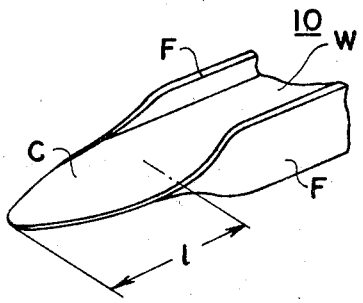
FIG. 1 is a perspective view of a crop formed at a tail end of a H shaped steel material.

Referring to the drawings, when rolling a shaped steel material on a universal mill, a crop C is formed at the tail end of a rolling material 10, as particularly shown in FIG. 1. FIG. 1 shows by way of example a rolling material for H shaped steel section which has a web W and flanges F. The length of the crop is normally in the range of 30 to 60 cm.

Figure 2:
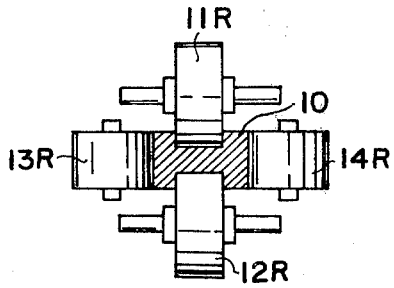
FIG. 2 is a front view showing general construction of a finishing universal mill.
Figure 3:
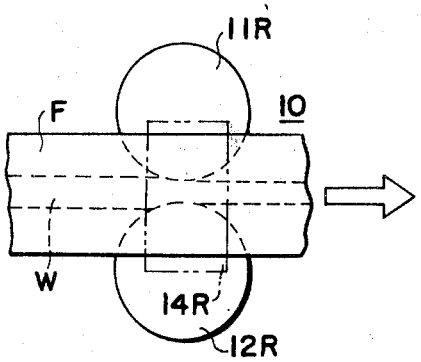
FIG. 3 is a side view generally showing the manner for rolling a normal or ordinary portion of a rolling material.

A universal mill for rolling a H shaped steel section generally comprises horizontal rolls 11R and 12R and vertical rolls 13R and 14R, as shown in FIG. 2.

Where the rolling material 10 has the flanges F, all of the rolls 11R, 12R, 13R and 14R are held in contact with the rolling material 10 as shown in FIG. 3, thus rolling material 10 into a normal H shape. However, in the flangeless crop portion C of the rolling material 10, the vertical rolls 13R and 14R no longer receive the rolling loads and only the horizontal rolls 11R and 12R are held in contact with the rolling material 10 for carrying out the rolling operation thereof.

In this connection, the coefficient of forward movement of a strip material is, for example, in the range of 1.02 to 1.03 (in the case of hot rolling with a thickness of 8.4 mm at the inlet and of 8.0 mm at the outlet) and is greater than the coefficient of forward movement of a H shape steel material which is usually in the range of 0.95 to 1.00. Thus, overfeeding occurs at the crop portion at the tail end of the rolling material which is in the form of a plane strip. Due to the difference in coefficient of forward movement between the flanged portion and the flangeless crop portion, the rolling material is forcibly pushed into the space between the roll stand which holds the tail end crop and the succeeding roll stand, imposing undue compressive force on the rolling material and as a result causing irregularities in the width of the flanges and deformations in the rolling material as a whole.

The term "coefficient of forward movement" is defined as $$\text{coefficient of forward movement} = \frac{\text{speed of rolling material in horizontal direction at outlet}}{\text{circumferential speed of roll}}$$

and may be better understood from the following discussion.

As mentioned above the relationship of the travel speed V of a rolling material to the circumferential speed $v$ of the rolls under the condition as shown in FIG. 3 is normally expressed as follows:

$$V = (0.95 \text{ to } 1.00)\, v$$

Figure 4:
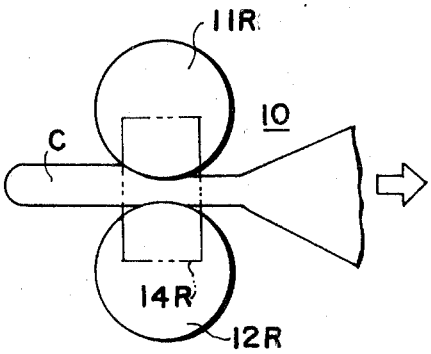
FIG. 4 is a side view diagramatically showing the manner for rolling a tail end crop of the rolling material.

Meanwhile, the feeding speed V′ of the rolling material, when the crop portion to be formed in normal rolling is shown in FIG. 1, passes through the mill, as shown in FIG. 4, can be expressed as follows.

$$V' = (1.02 \text{ to } 1.03)\, v$$

This is because the rolling material under this condition is considered to be similar in form to strip material.

While rolls normally rotate at constant speed, there necessarily occurs overfeeding in the amount corresponding to $V' - V = 0.02$ to 0.08 when the tail end crop portion enters, even if the circumferential speed of the rolls is kept constant. The overfeeding results in compression occuring in the steel material between stands in the amount corresponding to that of overfeeding. The compression caused by the overfeeding causes deformations in the shape of the rolled material. According to the present invention the overfeeding is compensated for, that is avoided, by reducing the rotation of the proceeding roll stand when the crop portion as shown in FIG. 1 enters the first or preceding roll stand.

In order to eliminate the feeding failure as mentioned above, the instant invention proposes to adjust the operating speed of the roll stand when the crop portion is introduced into the first roll stand thereby to prevent the deformations of the rolling material.

Figure 5:
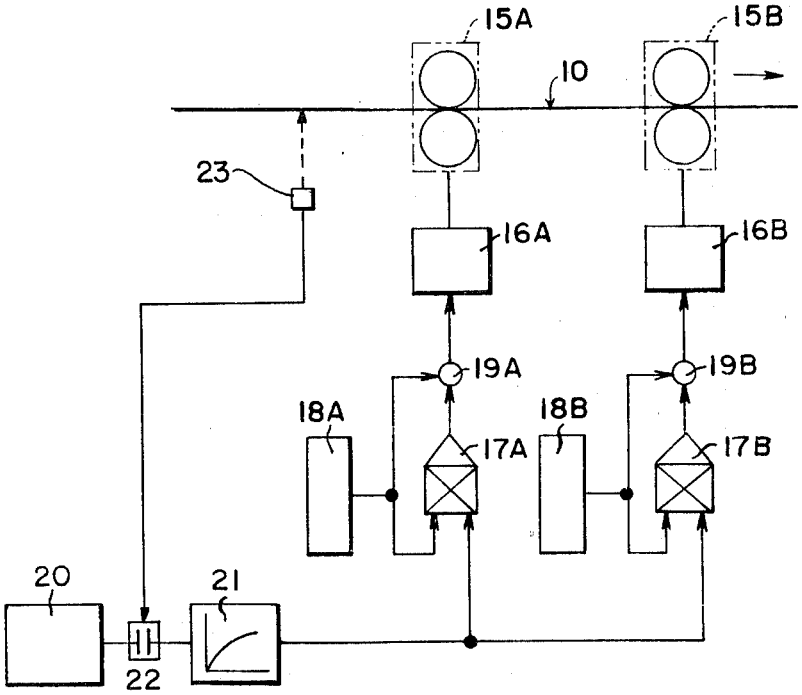
FIG. 5 is a block diagram of a rolling machine control system to which the tail end compensating method of the present invention is applied.

A preferred embodiment of the present invention will now be described with reference to FIG. 5. In FIG. 5, the reference numerals 15A and 15B designate, as representatives, two of a series of roll stands in a universal rolling mill. In the following description, the preceding one is referred to as a first roll stand and the succeeding one is referred to as a second roll stand for the convenience of explanation. Indicated at 16A and 16B are rolling mill driving means for rotatingly driving the respective roll stands. Designated at 17A and 17B are means for controlling the rolling mill driving means 16A and 16B just mentioned, and at 18A and 18B are speed setting devices. The operations of these components are well known in the art and thus will not be discussed herein in detail. The speed setting devices 18A and 18B function to set the operating speed of the horizontal rolls 11R and 12R of the roll stands 15A and 15B. The output signals of the speed setting devices 18A and 18B are fed to the respective points 19A and 19B one directly thereto and the other through the control means 17A, 17B for finally determining the operating speed in accordance with the sum thereof. The driving means 16A and 16B thus drive the roll stands 15A and 15B in accordance with the finally determined speed.

The control as mentioned above is satisfactory as long as the universal roll stands 15A and 15B deal with the normal or flanged portions of the rolling material. However, as soon as the tail end crop C is introduced into the first mill stand 15A, it becomes difficult to continue the rolling operation under the same conditions for the reasons as stated hereinbefore. That is to say, there occur undesired deformations in the rolling material due to overfeeding.

In the embodiment of the present invention, there are provided a compensation amount determining device 20, a functional generator 21 and a timing switch 22. The timing switch 22 is closed when the tail end crop C is introduced into the roll stand 15A, and a speed change signal issued from the compensation amount setting device 20 is applied to the functional generator 21 for reducing the operating speed of the roll stand 15A in accordance with the output of the functional generator through the control device 17A and the driving device 16A. Instead of lowering the speed of the roll stand 15A, arrangements may be made to increase the operating speed of the succeeding roll stand 15B. Of course, it is also possible to correct the operating speeds of both roll stands 15A and 15B. By such correction, the travel speed of the tail end crop C through the first roll stand 15A is controlled to a level equal to the travel speed of the normal flanged portion of the rolling material passing through the succeeding roll stand 15B, thus avoiding the deformations which would otherwise be caused due to overfeeding of the tail end crop portion C.

The accompanying drawing does not particularly show the means for closing the timing switch 22 upon detection of the tail end crop portion entering the preceding rolling mill, however, such means may be of the conventional type. For example, there may be used a detector 23 which is adapted to detect the entry of the tail end crop portion to the roll stand 15A or a load cell which is adapted to the roll stand 15A detect variations in the loads of the roll stands.

Furthermore, the correcting amount may be at most several percent of the normal operating speed of the rolling mill. The timewise or transitional changes of the correcting amount may be effected either stepwise or with time lags of the first order. It is therefore preferred that the compensation amount setting device 20 and the functional generator 21 are capable of effecting a speed correction of an amount of several percent stepwise and in terms of an exponential function.

In its broad sense, the speed change between the 2 roll stand receiving the tail end crop portion and the preceding steel portion follows a particular pattern. The pattern is dependent upon the shape of the crop portion. The pattern of the changing speed is essentially dependent upon the change of the coefficient of forward movement of the rolling material between the two roll stands. More specifically, the compensation introduced between these two roll stands serves to counteract any compression which results in the rolling material because of the cropped tail end crop and tends to restore the tension free condition even in the rolling material having the tail end crop. Furthermore, there is no ripple effect caused by the tail end crop to change the operation of the central portion of the rolling material. Therefore, the speed change is only maintained as long as the tail end is passing between the two roll stands. The present invention therefore determines the proper timing when the crop passes through a particular roll stand and then compensates by counteracting any compression force by producing an unbalance in speed only between the particular stand through which the crop is passing and the next succeeding stand. This unbalance is a function of the shape of the crop portion which determines the change in speed depending upon the change in the coefficient of forward movement. The length of the crop portion is generally as short as approximately 0.6 meters of the rolling material.

Figure 6:
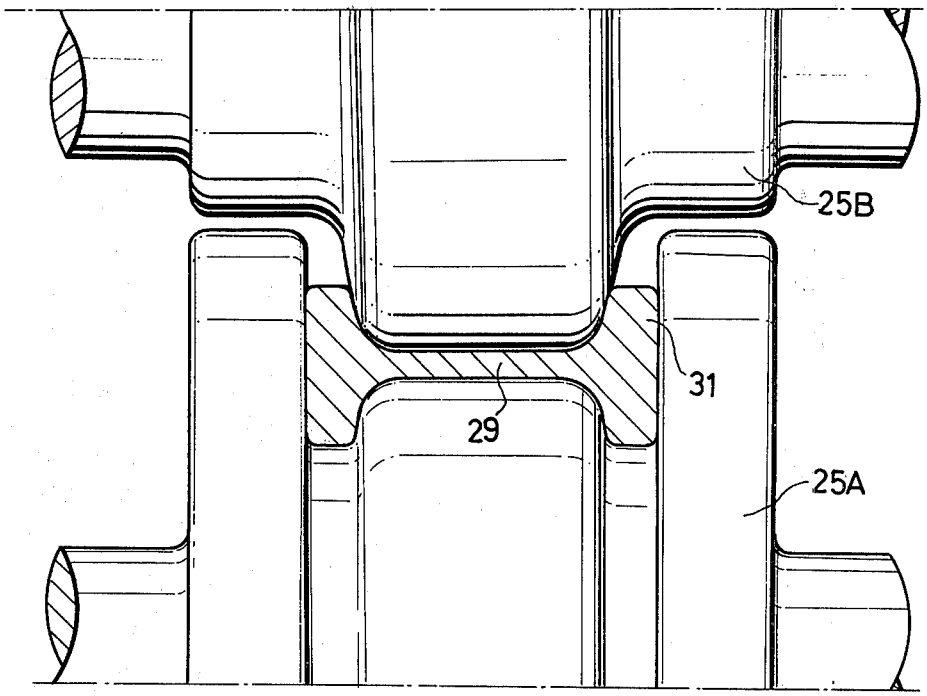
FIG. 6 is a front view of the grooved rolls acting on the rolling material.

In addition to utilizing a set of vertical rollers in conjunction with a set of horizontal rollers at a particular roll stand, it is possible to utilize a single set of grooved rollers. Referring now to FIG. 6 there is shown a set of grooved rollers including upper roll 25A, and lower roll 25B, which are utilized as a set of horizontal rollers.

The lower roll 25A includes a recessed portion 28 and two vertical grooves 27 located at the ends of the recess. The upper roll 25B includes a protruding portion 30 which fits into the recess but permits a spacing 31 between the lower roll and the upper roll. The shaped steel section 32 fits in the spacing 31 whereby a shaped steel double-T section can be rolled by a single set of horizontal rollers.

Even utilizing the grooved rollers there will also be the change in tension when a cropped tail end passes through the grooved rollers since the flanges will be missing and there will be less contact made with the rollers thereby producing less friction and causing a greater coefficient of forward movement of the rolling material through the grooved rollers.

Though the present invention has been explained with reference to two arbitrarily selected roll stands or a grooved roll, it will be understood that the same operating principles may be suitably applied to other roll stands of the mill.

According to the method of the present invention, the speed ratio between two successive roll stands is corrected when the tail end of the rolling material is rolled thereby to avoid irregularities in the width of the flanges. Experiments show that the accuracy of the flange width can be improved about 1 mm by employing the method of the present invention.

The foregoing is considered as illustrative only of the principles of the present invention. Further, since numerous modifications and changes will readily occur to those skilled in the art, it is not desired to limit the invention to the exact operation shown and described, and accordingly, all suitable modifications and equivalents may be resorted to, falling within the scope of the invention as defined in the appended claims. It is needless to say that the method of the present invention can be applied to rolling of shaped steel sections other than H shaped steel section.

What is claimed is:

1. A method for compensating for the tail end crop portion when continuously rolling shaped steel sections, said sections including a web section and a flange section, said tail end crop portion lacking said flange section and said rolling being in a tension-free condition using at least two roll stands; comprising the steps of detecting said tail end crop portion, correcting the speed ratio between a preceding roll stand and a succeeding roll stand when the crop portion is introduced into said preceding roll stand and maintaining said correction only while the tail end crop portion passes said preceding roll stand to restore a tension-free condition in the tail end crop portion.

2. The method of claim 1 wherein the speed of said preceding roll stand is reduced by a predetermined amount, in relation to said succeeding roll stand, when the tail end crop portion is introduced into said preceding roll stand.

3. The method of claim 1 wherein at least one of said roll stands comprises at least two pair of rolls to roll the shaped steel section.

4. The method of claim 1 wherein at least one of said roll stands includes a grooved roll.

* * * * *